US005136492A

United States Patent [19]

Rush

[11] Patent Number: 5,136,492

[45] Date of Patent: Aug. 4, 1992

[54] LIGHT DISPLAY

[76] Inventor: Garland I. Rush, 4003 Saddlerock Ct., Santa Rosa, Calif. 95405

[21] Appl. No.: 736,234

[22] Filed: Jul. 26, 1991

[51] Int. Cl.[5] ..... F21L 7/00

[52] U.S. Cl. ..... 362/367; 362/125; 362/812; 40/545; 368/67; 368/227

[58] Field of Search ..... 362/125, 367, 812; 368/67, 227; 40/545

[56] References Cited

FOREIGN PATENT DOCUMENTS 59-24284 2/1984 Japan ..... 368/227

336763 4/1959 Switzerland ..... 368/67

*Primary Examiner*—Carroll B. Dority

*Attorney, Agent, or Firm*—Larry D. Johnson

[57] ABSTRACT

A light display comprises a neon or other light source situated between two panels of semi-reflective, semi-transparent material supported in a box-like frame. When the light source is activated, the visual effect of viewing the light source from outside the frame yields a plurality of successively smaller images of the light source, analogous to seeing the shape of the light source being reflected and repeated into infinity.

4 Claims, 3 Drawing Sheets

LIGHT DISPLAY

BACKGROUND OF THE INVENTION

1. Field of the Invention

This invention relates generally to lights, signs, and other visual display apparatus, and more specifically to an improved light display for words, designs or other images.

2. Description of the Prior Art

Numerous signs and related displays utilize a light source to illuminate their design or message. In some cases, as with neon tubing, the light source itself may be bent or otherwise formed to define the desired characters or shape. For example, the neon tubing may be bent to form the spelling of words in a message, or to create a desired artistic shape. Typically, though, the resultant image is two-dimensional, and the display does not create any "depth" to the image.

SUMMARY OF THE INVENTION

The light display of this invention provides a neon or other light source situated between two panels of semi-reflective, semi-transparent material supported in a box-like frame. When the light source is activated, the visual effect of viewing the light source from outside the frame yields a plurality of successively smaller images of the light source, giving depth to the perceived image, and analogous to seeing the shape or form of the light source being reflected and repeated into infinity.

In order to achieve this visual effect, each of the panels must have some inherent reflectivity, or may be coated or otherwise treated to act as a partial (see-through) mirror, transmitting some portion of the light reaching it (e.g., fifty percent), and reflecting the remainder. By appropriate selection of different ratios of transmission/reflectivity of the respective panels, a greater or lesser intensity of depth and resultant reflected images may be achieved. Indeed, only the front panel must have some degree of transparency; the rear panel (behind the light source) may be entirely reflective, and still yield the desired repetitive reflections towards the front of the display. Otherwise, if both panels are semi-reflective (and semi-transparent), the series of repetitive reflections may be viewed from either side of the display.

In addition, by appropriate selection of the separation distance between the panels, and proper positioning of the light source between the panels, further control of the resultant reflected images can be achieved. For example, a greater separation distance between the panels yields a correspondingly greater distance between the reflected images. Also, placement of the light source closer to one panel than the other yields a staggered "paired" effect to the reflected images.

Finally, the panels need not necessarily be planar, or even parallel with one another. For example, a non-parallel front panel would yield a series of successively smaller images that tend toward the direction of the front panel orientation. Also, a non-planar front panel would yield correspondingly distorted reflected images.

DETAILED DESCRIPTION OF A PREFERRED EMBODIMENT

Figure 1:
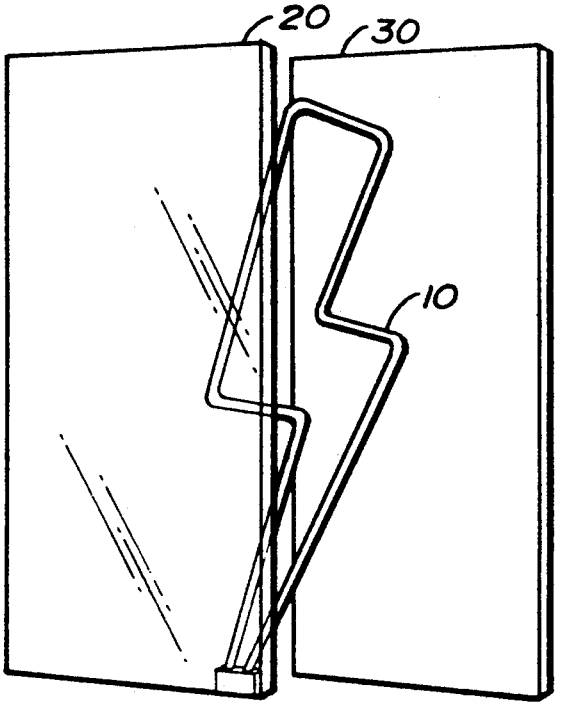
FIG. 1 is a perspective view of the functional optical components of a light display of this invention, including a free-form light source situated between two panels of optically semi-reflective material.

FIG. 1 is a perspective view of the functional optical components of a light display of this invention, including a free-form light source 10 situated between two panels of optically semi-reflective material 20, 30. Light source 10 comprises a shaped neon tube or similar light-emitting structure, which may or may not be planar in configuration. Front panel 20 must be semi-reflective, that is, able to transmit at least some portion of the incident light from the light source, while reflecting the remaining portion of the incident light towards back panel 30. Back panel 30 may be semi-reflective, like front panel 20, or may be entirely reflective. The overall dimensions of the light source and panels can of course vary by design.

Figure 2:
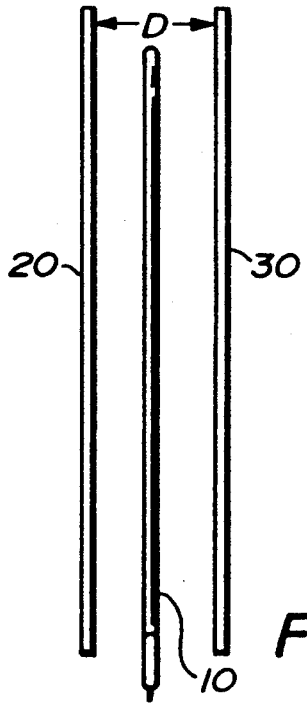
FIG. 2 is a side view of the functional optical components of the light display of FIG. 1, illustrating a typical separation distance between the two semi-reflective panels.

FIG. 2 is a side view of the functional optical components of the light display of FIG. 1, illustrating a typical separation distance D between the two semi-reflective panels 20, 30. Variation of separation distance D affects the "depth" of the perceived reflections.

Figure 3:
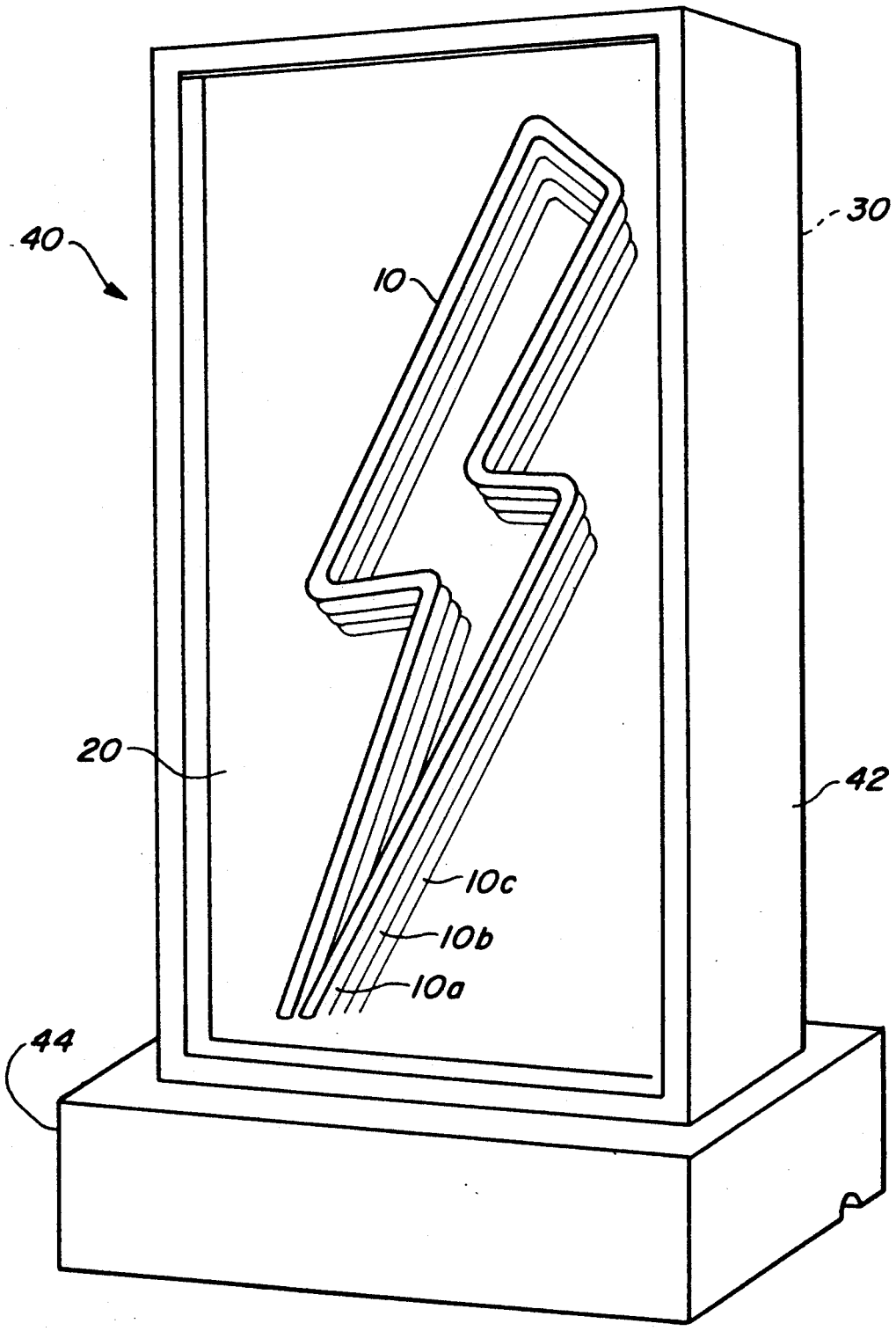
FIG. 3 is a perspective view of an assembled and operating light display of this invention, illustrating a plurality of successfully smaller reflected images of the light source, as perceived from the outside of the display.

FIG. 3 is a perspective view of an assembled and operating light display 40 of this invention, illustrating a plurality of successfully smaller reflected images **10*a*, 10*b*, 10*c* etc. of the light source 10, as perceived from the outside of the display. Display 40 includes a frame 42 to position and secure panels 20, 30 adjacent light source 10, and a base 44** to support the frame and house any necessary light generation components, such as a transformer and switch.

Figure 4:
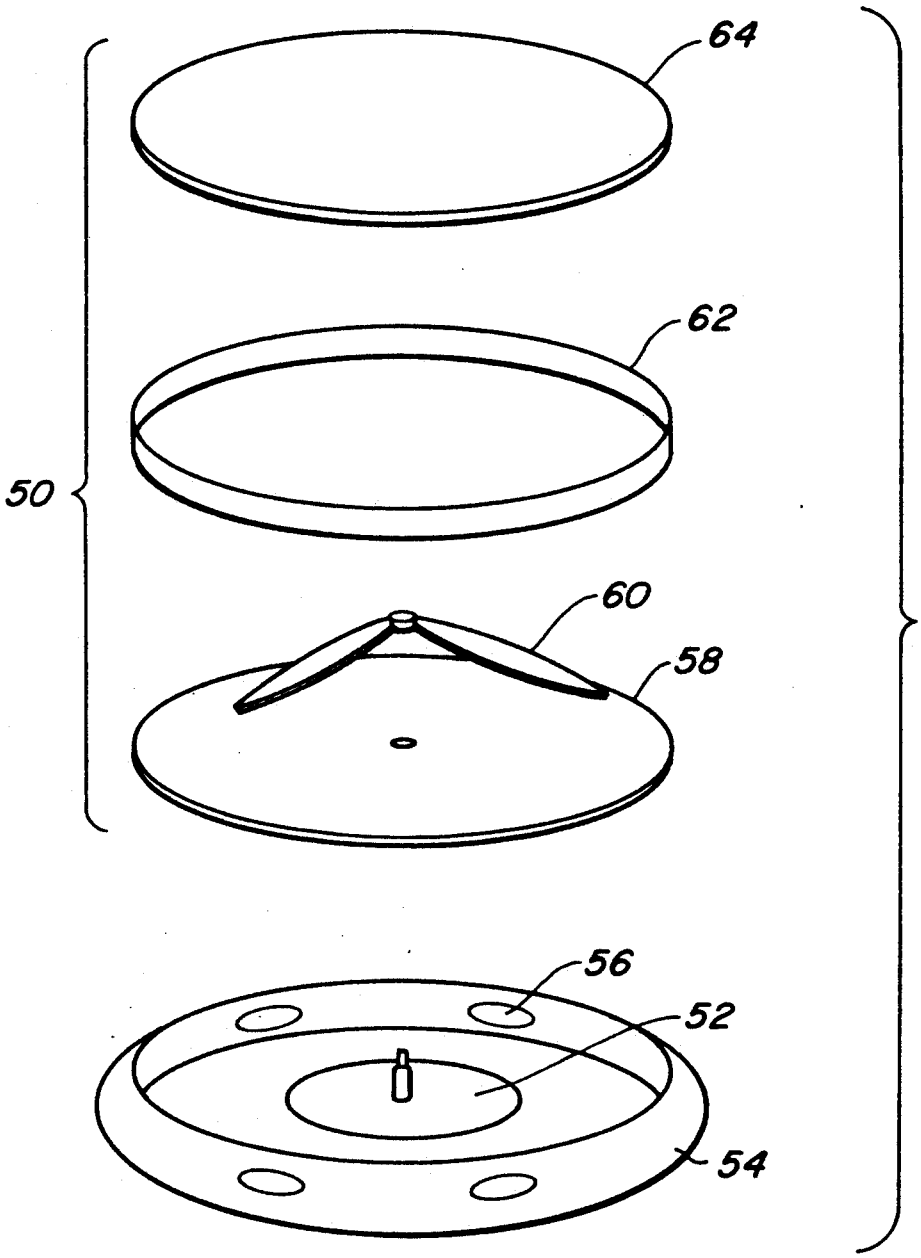
FIG. 4 is an exploded perspective view of a clock or watch embodiment of the light display of this invention.

FIG. 4 is an exploded perspective view of a clock or watch embodiment 50 of the light display of this invention. Clock 50 may include clockworks 52 within case 54, with a plurality of light sources 56 (such a miniature bulbs) disposed around the inner periphery of the case. A mirrored disk 58 positioned beneath the light sources acts as the back panel of the display, to reflect light back towards reflective clock hands 60. A transparent ring 62 may be used to better distribute the light from the light sources within the case. Crystal or cover 64 acts as the front panel, which is rendered semi-reflective by an appropriate coating or other means.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A light display comprising:

a light source comprising a shaped tubular light-emitting structure conditioned to deliver light in at least a first direction and a second direction opposite said first direction;

a first planar panel member adjacent said light source in said first direction, said first planar panel member conditioned to transmit some portion of the light delivered from said light source in said first direction, and to reflect the remaining portion of said light delivered from said light source in said first direction; and a second planar panel member parallel to said first planar panel member and adjacent said light source in said second direction, said second planar panel member conditioned to transmit some portion of the light delivered from said light source in said second direction, and to reflect the remaining portion of said light delivered from said light source in said second direction.

2. The light display of claim 1 including frame means for holding said first planar panel member and said second planar panel member adjacent said light source.

3. A light display comprising:

a light source comprising at least one light-emitting device, and further including a light-reflective element adjacent said light-emitting device;

a first panel member comprising a semi-reflective cover; and a second panel member comprising a reflective surface conditioned to reflect at least a portion of the incident light from said light source back towards said light-reflective element and said first panel member.

4. The light display of claim 3 wherein said light-reflective element comprises clock hand members operatively connected to a clock drive, said first panel member comprises a clock cover, and said second panel member comprises a mirrored disc, and further including a clock case supporting said clock hand members between said clock cover and said mirrored disc.

* * * * *